US011325395B2

(12) United States Patent
Hayashi

(10) Patent No.: US 11,325,395 B2
(45) Date of Patent: May 10, 2022

(54) PRINTER INCLUDING LIQUID DISCHARGE HEAD

(71) Applicant: BROTHER KOGYO KABUSHIKI KAISHA, Nagoya (JP)

(72) Inventor: Hideki Hayashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/119,503

(22) Filed: Dec. 11, 2020

(65) Prior Publication Data

US 2021/0178775 A1 Jun. 17, 2021

(30) Foreign Application Priority Data

Dec. 16, 2019 (JP) ..... JP2019-226482

(51) Int. Cl.
*B41J 2/175* (2006.01)

(52) U.S. Cl.
CPC ..... *B41J 2/17596* (2013.01)

(58) Field of Classification Search
CPC ..... B41J 2/17596; B41J 29/13; B41J 29/02; B41J 2/175
See application file for complete search history.

(56) References Cited

U.S. PATENT DOCUMENTS 8,356,867 B2 * 1/2013 Lee ..... B41J 2/17556 347/6
8,523,336 B2 * 9/2013 Kuribayashi ..... B41J 2/17596 347/85
10,207,515 B2 * 2/2019 Nakamura ..... B41J 2/18
2009/0179928 A1 7/2009 Nemoto et al.
2009/0244231 A1 10/2009 Tsuji et al.
2011/0050793 A1 * 3/2011 Kumagai ..... B41J 2/17596 347/22
2013/0222447 A1 8/2013 Miura
2015/0070457 A1 3/2015 Okuda et al.
2015/0251433 A1 9/2015 Miyazawa
2016/0288523 A1 * 10/2016 Ohtsu ..... B41J 2/1707

FOREIGN PATENT DOCUMENTS

JP 2001-212948 A 8/2001
JP 2003-112453 A 4/2003
JP 2009-166338 A 7/2009
JP 2009-233876 A 10/2009
(Continued)

*Primary Examiner* — An H Do

(74) *Attorney, Agent, or Firm* — Scully, Scott, Murphy & Presser, PC

(57) ABSTRACT

There is provided a printer including: a casing defining an internal space; a conveyor; a head; a tank, a first channel communicating the tank and the head with each other; a first pressure gauge; a first pump; a second channel communicating the tank and the head with each other; a second pressure gauge; and a second pump. The internal space includes a first space defined between a first virtual surface and a second virtual surface which are parallel to a conveyance direction and an up-down direction 7, and a second space which is different from the first space; the head is positioned in the first space; and the tank, the first pressure gauge, the first pump, the second pressure gauge, and the second pump are positioned in the second space.

14 Claims, 8 Drawing Sheets

(56) References Cited

FOREIGN PATENT DOCUMENTS

| | | | |
|---|---|---|---|
| JP | 2011-93218 | A | 5/2011 |
| JP | 2012-121713 | A | 6/2012 |
| JP | 2018-67081 | A | 4/2013 |
| JP | 2013-199108 | A | 10/2013 |
| JP | 2013-220531 | A | 10/2013 |
| JP | 2013-252686 | A | 12/2013 |
| JP | 2015-51575 | A | 3/2015 |
| JP | 2015-107599 | A | 6/2015 |
| JP | 2015-168197 | A | 9/2015 |
| JP | 2016-52767 | A | 4/2016 |

* cited by examiner

PRINTER INCLUDING LIQUID DISCHARGE HEAD

CROSS REFERENCE TO RELATED APPLICATION

The present application claims priority from Japanese Patent Application No. 2019-226482, filed on Dec. 16, 2019, the disclosure of which is incorporated herein by reference in its entirety.

BACKGROUND

Field of the Invention

The present disclosure relates to a printer which discharges a liquid from a nozzle of a head.

Description of the Related Art

In a printer, in a case that a gas enters into and is mixed with a liquid in a first tank provided on a head, an inconvenience such as any discharge failure (unsatisfactory discharge) of the liquid is caused, in some cases.

In order to prevent the above-described inconvenience, there is known a printer in which a gas entered into and mixed with the liquid in the first tank is sucked by a pump together with the liquid and is collected to a second tank (e.g., an ink cartridge), thereby removing the gas in the first tank and circulating the liquid, from which the gas has been removed, again to the head. A certain publicly known printer is provided with a circulating device. The circulating device includes a circulation channel arranged between the first tank and the second tank, and a pump arranged in the circulation channel, and the gas in the first tank is delivered to the second tank by the suction force of the pump.

SUMMARY

In the publicly known printer, the circulating device is positioned at a location above the head. Therefore, the printer becomes to be large in the up-down direction. In addition, in such a case that the liquid circulated through the circulating device leaks, the leaked liquid adheres to the head and/or the sheet positioned at a location below the head.

The present disclosure has been made in view of the above-described circumstances, and an object of the present disclosure is to provide a printer capable of preventing, in a case that the liquid leaks, the leaked liquid from adhering to a head and/or a sheet, while suppressing any increase in the size of the printer in the up-down direction.

According to an aspect of the present disclosure, there is provided a printer including: a casing defining an internal space; a conveyor configured to convey a medium in a conveyance direction; a head arranged to face the medium conveyed at a location above the medium, and configured to discharge a liquid toward the medium; a tank configured to store the liquid; a first channel communicating the tank and the head; a first pressure gauge positioned in the first channel and configured to detect a first pressure between the tank and the head in the first channel; a first pump configured to adjust the first pressure; a second channel communicating the tank and the head; a second pressure gauge positioned in the second channel and configured to detect a second pressure between the head and the tank in the second channel; and a second pump configured to adjust the second pressure. The internal space includes a first space defined between a first virtual surface and a second virtual surface which are parallel to the conveyance direction and an up-down direction, and a second space which is different from the first space. The head is positioned in the first space. The tank, the first pressure gauge, the first pump, the second pressure gauge, and the second pump are positioned in the second space.

DESCRIPTION OF THE EMBODIMENTS

Figure 1:
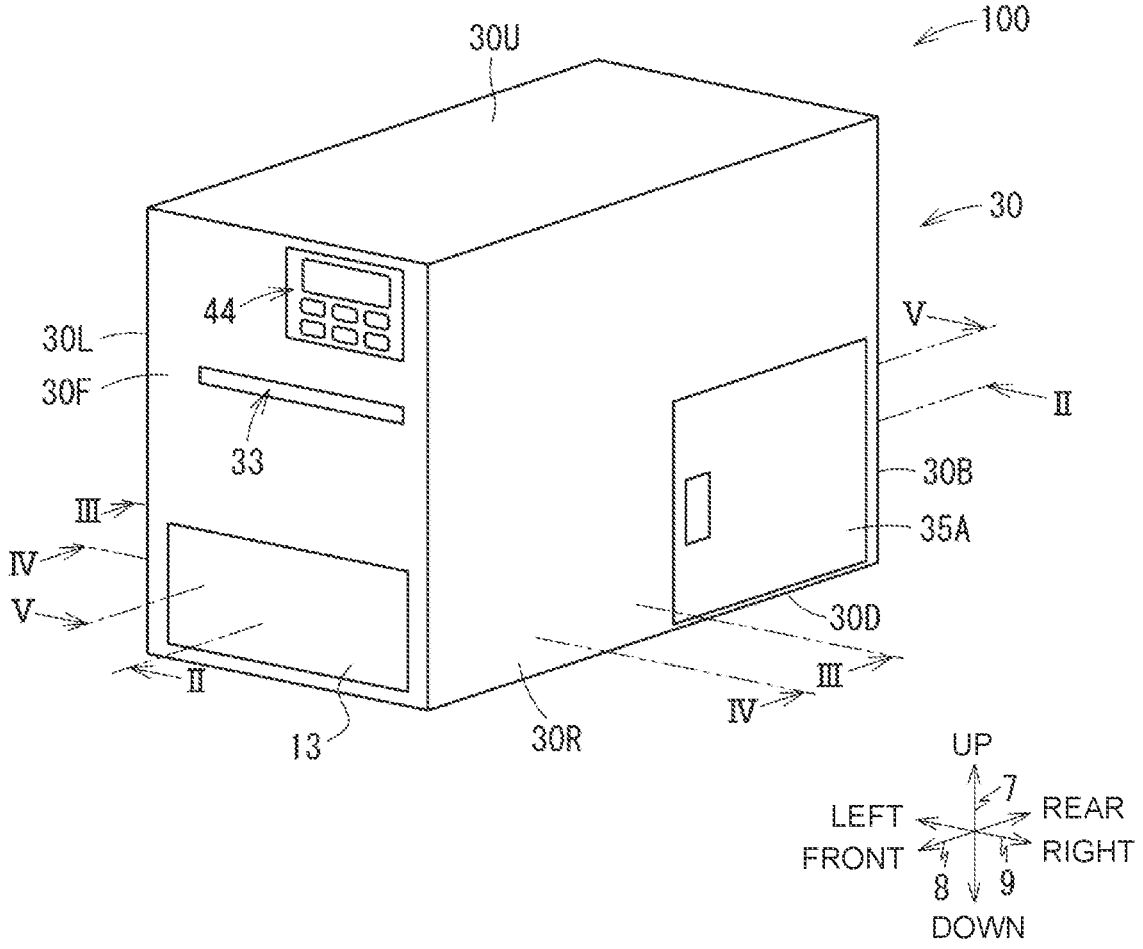
FIG. 1 is a perspective view depicting the outer appearance of an image recording apparatus 100.

An image recording apparatus 100 according to an embodiment of the present disclosure will be explained below. Note that the embodiment which is to be explained below is merely an example of the present disclosure; it is needless to say that the embodiment can be appropriately changed without changing the gist of the present disclosure. Further, in the following description, an up-down direction 7 is defined, with a state in which the image recording apparatus 100 is operably installed (the state of FIG. 1) as the reference; a front-rear direction 8 is defined, with a side on which a discharge port 33 is provided is defined as a front side (front surface); and a left-right direction 9 is defined, with the image recording apparatus 100 as seen from the front side (front surface). The up-down direction 7, the front-rear direction 8, and the left-right direction 9 are orthogonal to each other.

<Configuration of Outer Appearance of Image Recording Apparatus 100>

Figure 2:
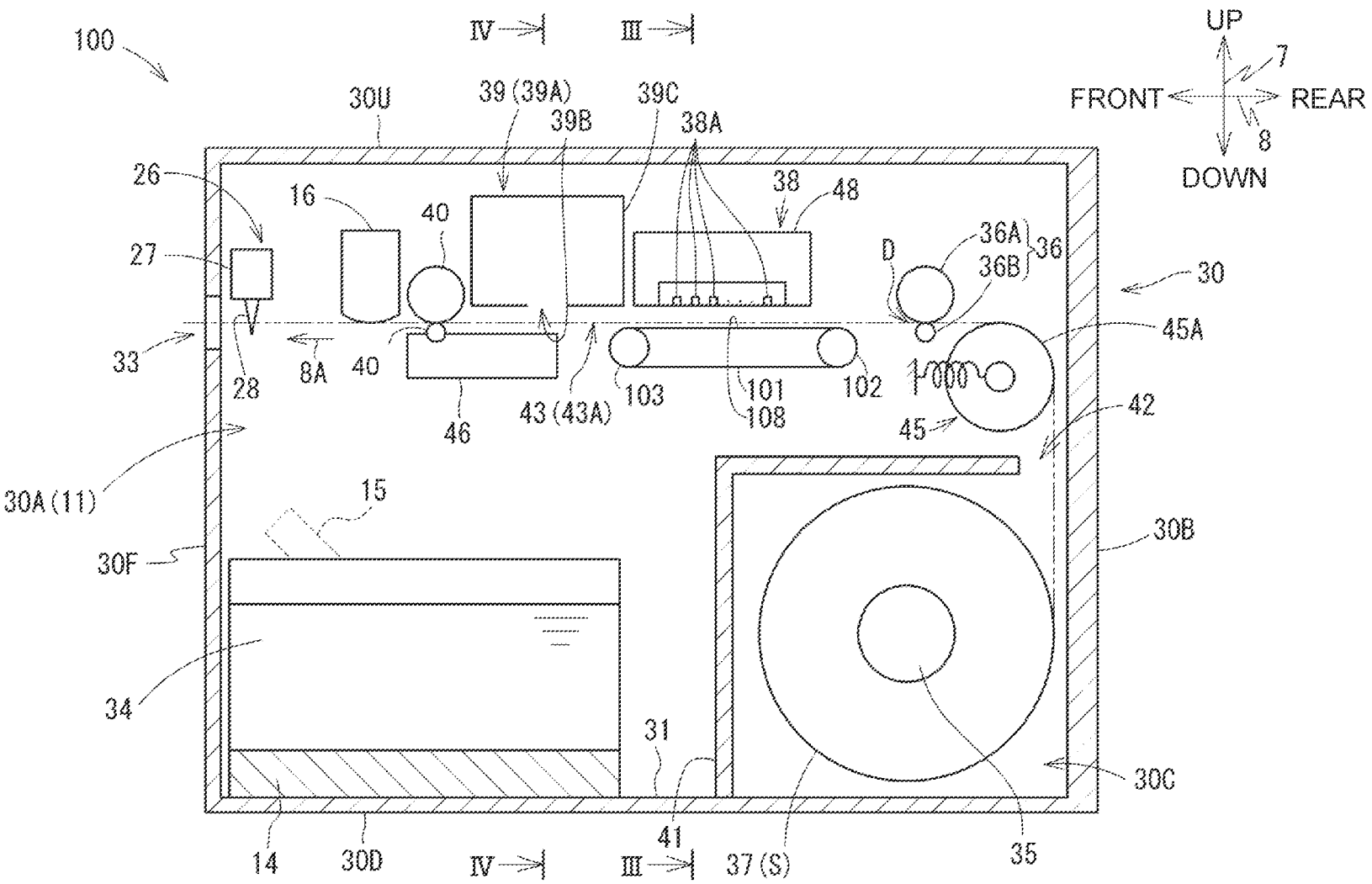
FIG. 2 is a cross-sectional view depicting a II-II cross-section of FIG. 1.

The image recording apparatus 100 (an example of a "printer") as depicted in FIG. 1 records, in the ink-jet recording system, an image on a sheet S (an example of a "medium") forming a roll body 37 (see FIG. 2).

As depicted in FIG. 1, the image recording apparatus 100 includes a casing 30. The casing 30 has a substantially rectangular parallelepiped shape and has a size placeable or arrangeable on a table or desk. That is, the image recording apparatus 100 is suitable for use by being placed on the table or desk. Of course, the image recording apparatus 100 may be used while being placed on a floor surface or a rack.

The casing 30 has a right surface 30R and a left surface 30L, an upper surface 30U and a lower surface 30D, and a front surface 30F and a rear surface 30B. With this, an internal space 30A (see FIG. 2) of the casing 30 is partitioned from the outside. The right surface 30R and the left surface 30L are located apart from each other in the left-right direction 9 (an example of a "width direction"). The upper surface 30U connects an upper end of the right surface 30R and an upper end of the left surface 30L. The lower surface 30D connects a lower end of the right surface 30R and a lower end of the left surface 30L. The front surface 30F and the rear surface 30B are located apart from each other in the front-rear direction 8.

As depicted in FIG. 1, a slit-shaped discharge port 33 which is long in the left-right direction 9 is formed in the front surface 30F of the casing 30. A sheet S, on which the image recording has been performed (see FIG. 2) is discharged from the discharge port 33.

An operation panel 44 is provided on the front surface 30F of the casing 30. A user performs, via the operation panel 44, input for operating the image recording apparatus 100 and input for confirming a variety of kinds of settings.

<Internal Configuration of Image Recording Apparatus 100>

Figure 5:
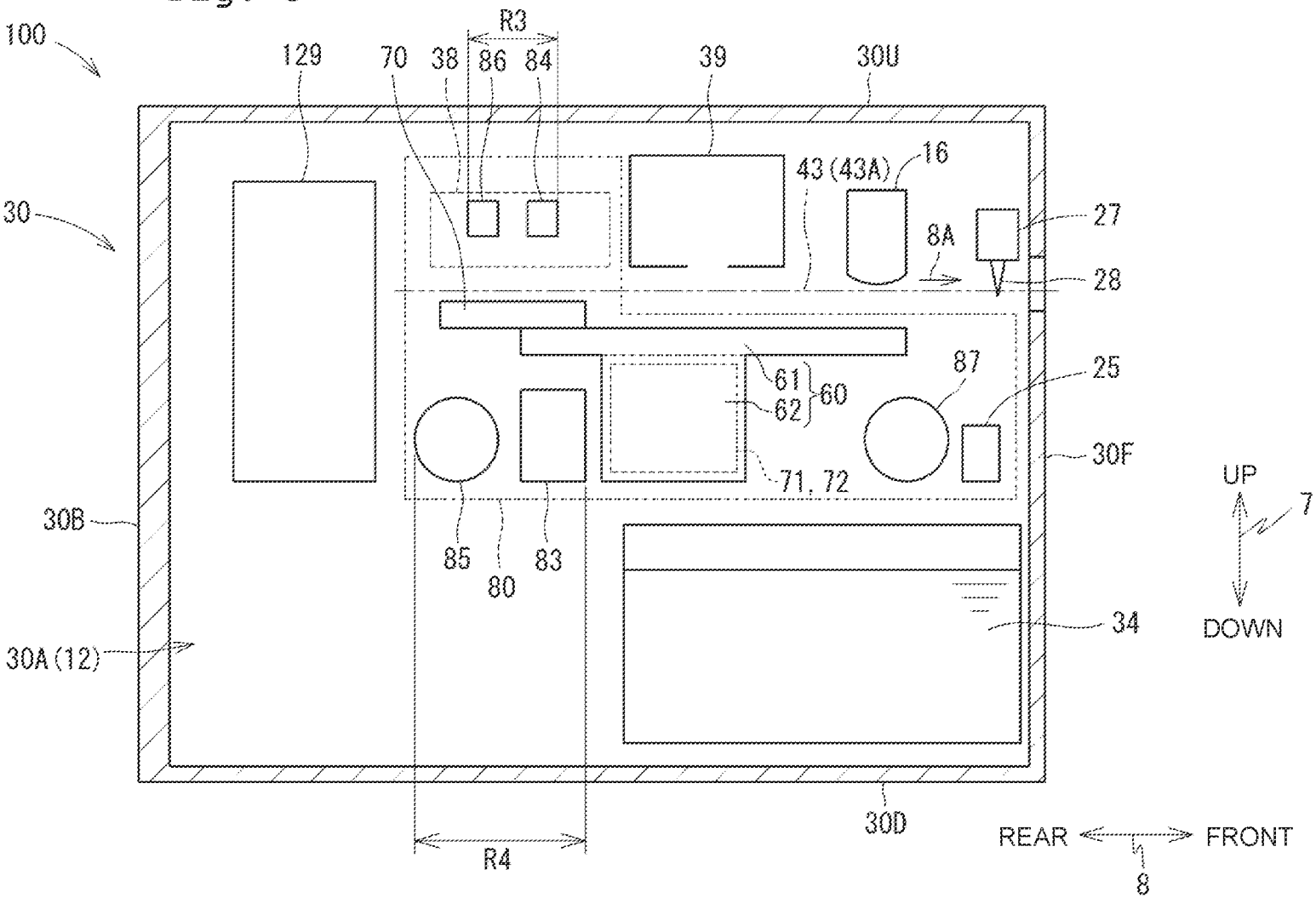
FIG. 5 is a cross-sectional view depicting a V-V cross section of FIG. 1.

As depicted in FIG. 2, a holder 35, a tensioner 45, a conveying roller pair 36, a conveying roller pair 40, a conveying belt 101, a head 38, a fixing part 39, a supporting member 46, a CIS 16, a cutter unit 26, a main tank 34 (an example of a "first tank"), etc., are arranged in the internal space 30A. The conveying roller pair 36, the conveying roller pair 40, and conveyor belt 101 are an example of a "conveyor". Further, as depicted in FIG. 5, a main substrate 129 and a circulating mechanism 80 are arranged in the internal space 30A.

A partition wall 41 is provided in the internal space 30A. The partition wall 41 partitions a rear lower part of the internal space 30A so as to define a sheet accommodating space 30C. The sheet accommodating space 30C is a space which is surrounded by the partition wall 41 and the casing 30 (specifically, the rear surface 30B, the lower surface 30D, the right surface 30R, and the left surface 30L) and which is isolated from the head 38, etc.

The roll body 37 is accommodated in the sheet accommodating space 30C. The roll body 37 has a core tube and the sheet S which is elongated. The sheet S is wound around the core tube in a roll shape in the circumferential direction of the axial core of the core tube. The sheet S may have a width ranging from a minimum width to a maximum width in which the image recording apparatus 100 is capable of recording an image. That is, a plurality of types of the roll body 37 having different widths are accommodatable in the sheet accommodating space 30C. Note that it is allowable that the roll body 37 does not have a core tube, and that the sheet S is wound in a roll shape so that the sheet is installable in the holder 35. Further, it is allowable that the sheet accommodating space 30C is capable of accommodating a fan-folded paper.

As depicted in FIG. 2, the holder 35 extending along the left-right direction 9 is positioned in the sheet accommodating space 30C. One type of the roll body 37, which is selected from a plurality of types of the roll body 37, is installable in the holder 35. In a case that the roll body 37 is installed in the holder 35, the holder 35 supports the roll body 37 such that the axial core of the core tube of the roll body 37 is along the left-right direction 9 and that the roll body 37 is rotatable in the circumferential direction of the axial core of the core tube. Further, the center in the width direction of the sheet S is located at the center in the left-right direction 9 (hereinafter also referred to as the "center in sheet passing") of the conveyance path 43. The holder 35 is rotated by a driving force transmitted thereto from a non-illustrated conveying motor. Accompanying with the rotation of the holder 35, the roll body 37 supported by the holder 35 also rotates. Note that as depicted in FIG. 1, a right cover 35A is positioned in the right surface 30R of the casing 30. In a case that the right cover 35A is opened, the holder 35, etc., positioned in the inside of the sheet accommodating space 30C is exposed; in a case that the right cover 35A is closed, the holder 35, etc., is shielded.

As depicted in FIG. 2, the sheet accommodating space 30C is opened upward at a rear part of the sheet accommodating space 30C. More specifically, a gap 42 is defined between the partition wall 41 and the rear surface 30B, that is, at a location above a rear end of the roll body 37. In a case that the conveying roller pairs 36 and 40 are rotated, the sheet S is thereby drawn upward from the rear end of the roll body 37 and is guided to the tensioner 45 via the gap 42.

The tensioner 45 is positioned in the rear part of the internal space 30A, at a location above the partition wall 41. The tensioner 45 has an outer circumferential surface 45A facing the outside of the casing 30. The width in the left-right direction 9 of the outer circumferential surface 45A is not less than the maximum width of the sheet, and has a shape symmetrical to each other with respect to the center in the sheet passing. An upper end of the outer circumferential surface 45A is at a position which is substantially same, in the up-down direction 7, as a nip D of the conveying roller pair 36.

The sheet S pulled out from the roll body 37 is put or placed on and makes contact with the outer circumferential surface 45A. The sheet S is curved forward along the outer circumferential surface 45A, extends in the conveyance direction 8A, and is guided to the conveying roller pair 36. The conveyance direction 8A is a forward orientation along the front-rear direction 8. The tensioner 45 imparts a tension to the sheet S in a well-known method.

Note that the tensioner 45 is not limited to or restricted by the configuration which imparts a rearward biasing force to the roller by a biasing member such as a spring, etc., as depicted in FIG. 2; it is allowable to apply other well-known technique to the tensioner 45.

The conveying roller pair 36 is positioned in front of (on the front side of) the tensioner 45. The conveying roller pair 36 has a conveying roller 36A and a pinch roller 36B. The conveying roller 36A and the pinch roller 36B make contact with each other at a position in the up-down direction 7 which is substantially same as the upper end of the outer circumferential surface 45A, to thereby form the nip D.

The conveying roller pair 40 is positioned in front of the conveying roller pair 36. The conveying roller pair 40 has a conveying roller 40A and a pinch roller 40B. The conveying roller 40A and the pinch roller 40B make contact with each other at a position in the up-down direction 7 which is substantially same as the upper end of the outer circumferential surface 45A, to thereby form a nip.

The conveying rollers 36A and 40A rotate by the driving force transmitted thereto from the non-illustrated conveying motor. The conveying roller pair 36 rotates while nipping the sheet S extending in the conveyance direction 8A from the tensioner 45, to thereby feed out the sheet S in the conveyance direction 8A along a conveying surface 43A. The conveying roller pair 40 rotates while nipping the sheet S fed from the conveying roller pair 36, to thereby feed out the sheet S in the conveyance direction 8A. Further, by the rotations of the conveying roller pairs 36 and 40, the sheet S is drawn from the sheet accommodating space 30C via the gap 42 and toward the tensioner 45.

As depicted in FIG. 2, a conveyance path 43 extending from the upper end of the outer circumferential surface 45A and arriving at the discharge port 33 is formed in the internal space 30A. The conveyance path 43 extends substantially linearly along the conveyance direction 8A, and is a space in which the sheet S can pass. Specifically, the conveyance path 43 is along a conveying surface 43A which spreads in the conveyance direction 8A and in the left-right direction 9 and which is long in the conveyance direction 8A. Note that in FIG. 2, the conveying surface 43A is indicated by a two-dot chain line indicating the conveyance path 43. The conveyance path 43 is defined by non-illustrated guide members located away from each other in the up-down direction 7, the head 38, the conveying belt 101, the supporting member 46, and the fixing part 39. That is, the head 38, the conveying belt 101, the supporting member 46, and the fixing part 39 are positioned along the conveyance path 43.

The conveying belt 101 is positioned at a location below the conveyance path 43 and on the downstream side in the conveyance direction 8A with respect to the conveying roller pair 36. The conveying belt 101 is an endless belt. The conveying belt 101 is stretched between a driving roller 102 and a driven roller 103. The conveying belt 101 is arranged in the inside of the conveyance path 43 in the left-right direction 9. The driving roller 102 and the driven roller 103 are rotatably supported by a non-illustrated frame. The driving roller 102 and the driven roller 103 are spaced apart from each other in the front-rear direction 8 (conveyance direction 8A). The driving roller 102 is rotated by a driving force transmitted thereto from the non-illustrated conveying motor. The driven roller 103 rotates accompanying with the rotation of the driving roller 102. Thus, the conveying belt 101 conveys the sheet S which is supported thereby in the conveyance direction 8A.

The head 38 is positioned or located at the downstream side in the conveyance orientation 8A with respect to the conveying roller pair 36. Further, the head 38 faces or is opposite to the conveyance path 43, at a location above the conveyance path 43 in the up-down direction 7. Further, the head 38 faces the conveying belt 101, with the conveyance path 43 being interposed therebetween. The head 38 has a plurality of nozzles 38A. From the plurality of nozzles 38A, an ink (an example of a "liquid") is discharged or ejected downward toward the sheet S supported by the conveying belt 101. As a result, an image is recorded on the sheet S.

The fixing part 39 is located on the downstream side in the conveyance direction 8A with respect to the head 38 and on the upstream side in the conveyance direction 8A with respect to the conveying roller pair 40, at a location above the conveyance path 43. The fixing part 39 is a UV radiator (ultraviolet light radiator) having a substantially rectangular parallelepiped shape which is elongated in the left-right direction 9. The fixing part 39 has a casing 39A. An opening 39B along the left-right direction 9 is formed in a lower wall of the casing 39A. The fixing part 39 radiates an ultraviolet light through the opening 39B. With this, the ultraviolet light is irradiated onto the sheet S and/or the ink on the sheet S passing immediately below the opening 39B. In the present embodiment, the ink contains a resin which is cured by the ultraviolet light. Therefore, the ink irradiated with the ultraviolet light is fixed to the sheet S.

Note that the fixing part 39 is not limited to being the UV irradiator. For example, the fixing part 39 may be a halogen heater having a substantially rectangular parallelepiped shape which is elongated in the left-right direction 9. In such a case, the fixing part 39 radiates an infrared light via the opening 39B and heats the sheet S and/or the ink on the sheet S passing immediately below the opening 39B. Thus, the ink is fixed on the sheet S. In this case, it is allowable that the ink does not contain a resin which is cured by the ultraviolet light. For example, the ink may contain a heat-curable resin.

The supporting member 46 is positioned below the conveyance path 43. The supporting member 46 is located on downstream side in the conveyance direction 8A with respect to the head 38 and the conveying belt 101. A rear part of the supporting member 46 faces or is opposite to the fixing part 39. A front part of the supporting member 46 faces the conveying roller 40A. The supporting member 46 supports the sheet S which has been conveyed in the conveyance direction 8A by the conveying belt 101.

The CIS 16 is located on the downstream side in the conveyance orientation 8A with respect to the conveying roller pair 40, at a location above the conveyance path 43. In a case that a reflected light, of a light emitted from a light source such as an LED and reflected by the sheet, is collected to a line sensor by a refractive index distribution type lens, the CIS 16 is configured to output an electric signal corresponding to the intensity of the reflected light received by the line sensor. This allows the CIS 16 to read an image of a printed surface of the sheet. The CIS 16 is arranged so that the left-right direction 9 is a read-line.

The cutter unit 26 is located on the downstream side in the conveyance direction 8A with respect to the CIS 16 at a location above the conveyance path 43. The cutter unit 26 has such a configuration wherein a cutter 28 is mounted on a cutter carriage 27. The cutter carriage 27 moves in the conveyance path 43 in the left-right direction 9, by a non-illustrated belt-driving mechanism, etc. The cutter 28 is positioned so as to cross the conveyance path 43 in the up-down direction 7; accompanying with the movement of the cutter carriage 27, the cutter 28 moves in the conveyance path 43 in the left-right direction 9. By the movement of the cutter 28, the sheet S located in the conveyance path 43 is cut along the left-right direction 9.

Figure 4:
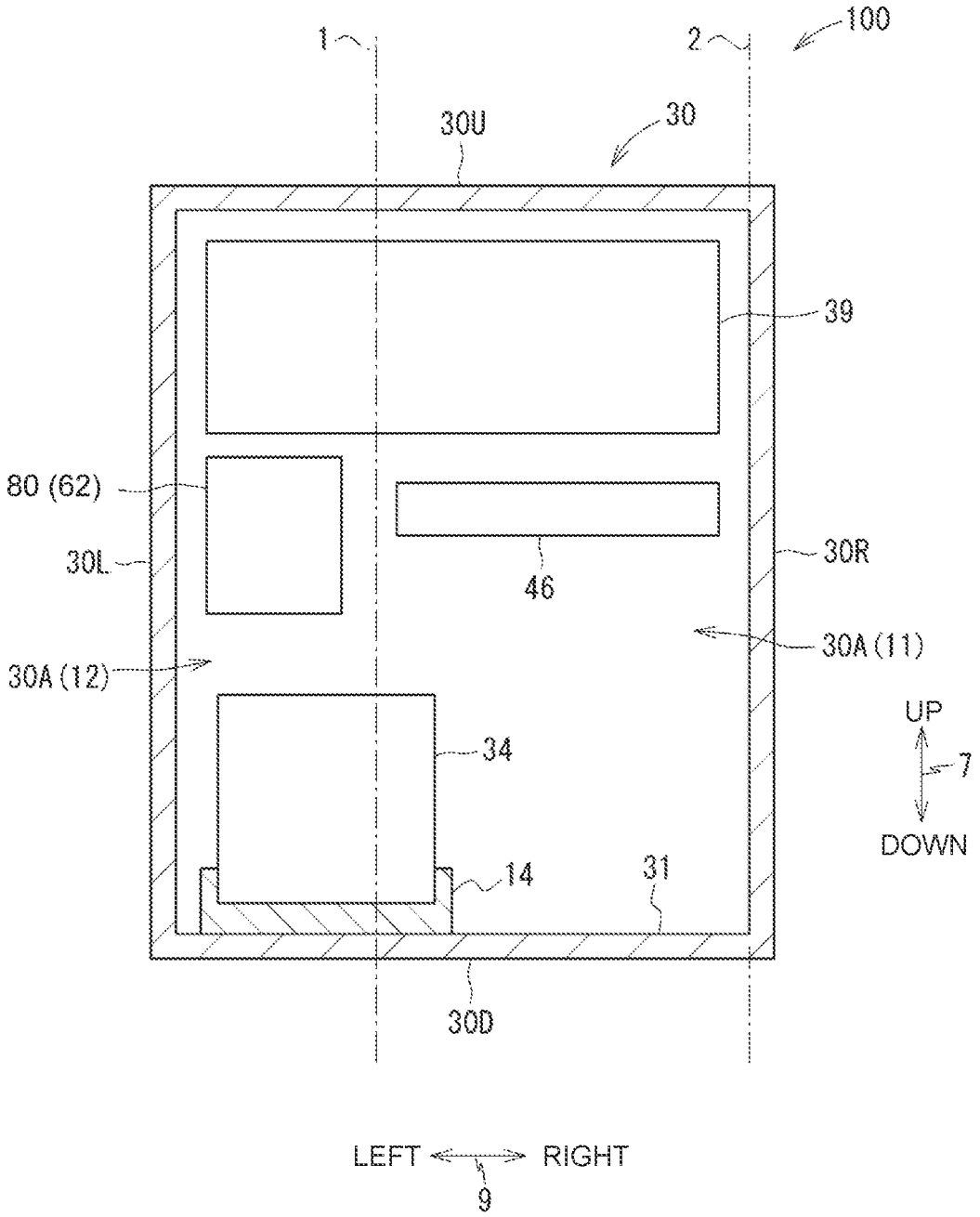
FIG. 4 is a cross-sectional view depicting a IV-IV cross section of FIG. 1.

The main tank 34 stores the ink. The ink is a liquid containing a pigment, etc. The ink has a viscosity suitable for uniformly dispersing the pigment. The pigment is a component which serves as the color of the ink. The ink is supplied from the main tank 34 to the circulating device 80 through a non-illustrated tube. In the present embodiment, the main tank 34 is attachable/detachable with respect to the casing 30, via an openable/closable front cover 13 (see FIG. 1) provided on the front surface 30F of the casing 30. As depicted in FIGS. 2 and 4, the main tank 34 installed in the casing 30 slides (slidably moves) in the front-rear direction 8 with respect to the casing 30 by a tank holder 14 provided on a bottom surface 31 of the casing 30, to be thereby attachably/detachably held with respect to the casing 30. Note that the configuration of the tank holder 14 is not limited to the configuration depicted in FIGS. 2 and 4.

Note that the main tank 34 may be fixed to the casing 30.

As depicted in FIG. 5, the main substrate 129 is positioned at a location behind (on the rear side of) the head 38 in the front-rear direction 8. Further, the main substrate 129 is positioned on the left side in the left-right direction 9 with respect to the conveying roller pair 36, the head 38, and the conveying belt 101 (see FIG. 2). Further, the main substrate 129 is located, in the up-down direction 7, in a range from an upper end part of the head 38 to a lower end part of the circulating mechanism 80.

The main substrate 129 is a substrate having a function of a controller which controls an operation of the image recording apparatus 100. The main substrate 129 is electrically connected to other substrates such as a non-illustrated head-control board which controls the head 38, a non-illustrated power supply board, etc., and to the respective constitutive elements as described above. Although the main substrate 129 has such a configuration wherein various electronic elements are assembled to a printed circuit board, any explanation of the circuit configuration, etc., of the main substrate 129 is omitted here.

The circulating mechanism 80 depicted in FIG. 5 circulates the ink, supplied from the main tank 34, between a sub tank 83 (an example of a "tank" and a "second tank") and the head 38. The configuration of the circulating mechanism 80 will be described in detail later.

Figure 3:
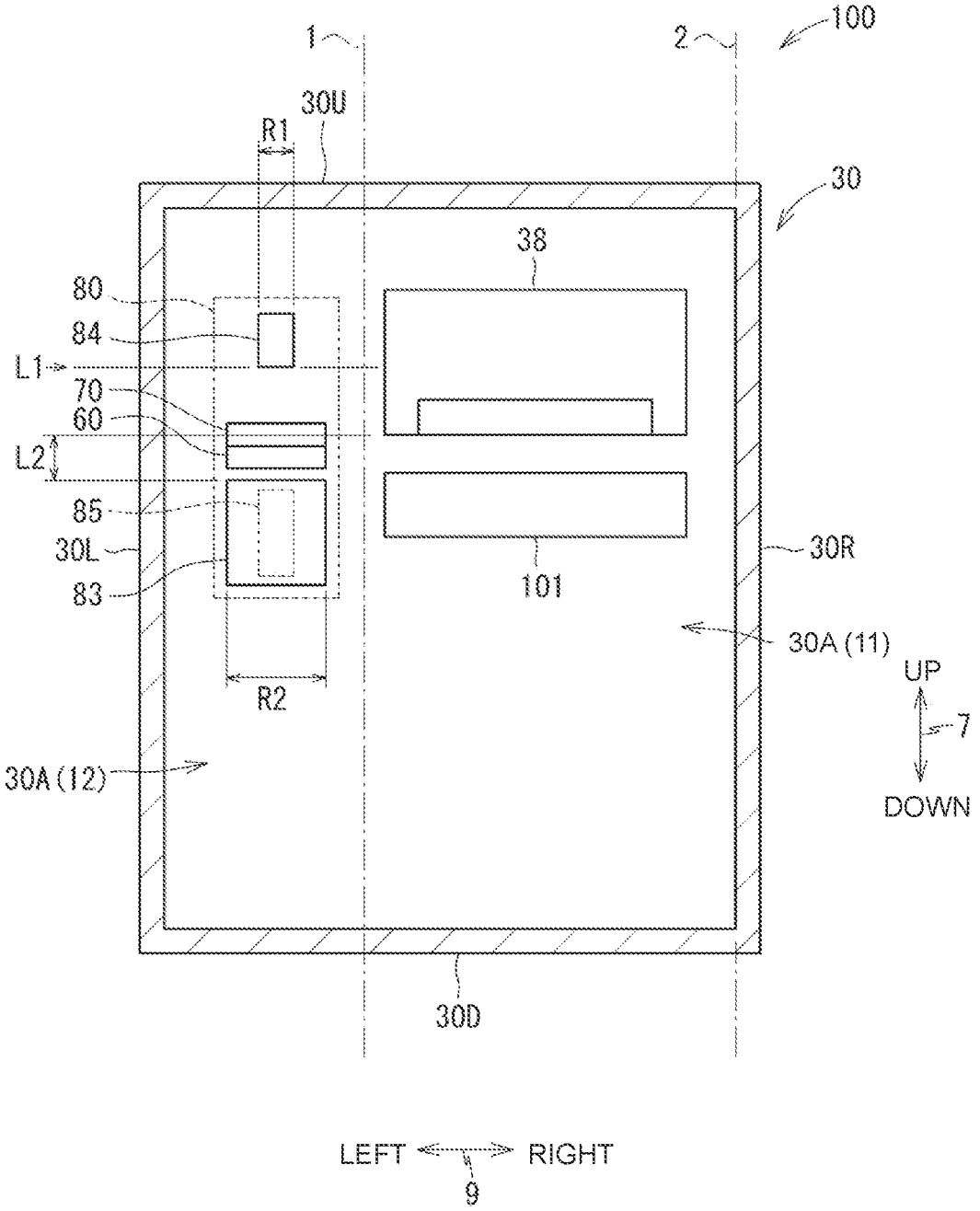
FIG. 3 is a cross-sectional view depicting a cross-section of FIG. 1.

As depicted in FIG. 5, the circulating mechanism 80 is located, in the front-rear direction 8, in a range from a rear end part of the head 38 to the cutter unit 26. Further, as depicted in FIGS. 3 and 5, a rear part of the circulating mechanism 80 (specifically, a part, of the circulating mechanism 80, in which the sub tank 83, the first pressure gauge 84, the first pump 85 and the second pressure gauge 86 are arranged) is located on the left side in the left-right direction 9 with respect to the head 38 and the conveying belt 101. Furthermore, as depicted in FIGS. 4 and 5, a central part of the circulating mechanism 80 (specifically, a part, of the circulating mechanism 80, in which a thick part 62 is arranged) is positioned below the fixing part 39, and is positioned on the left side with respect to the supporting member 46. Moreover, as depicted in FIG. 5, a front part of the circulating mechanism 80 (specifically, a part, of the circulating mechanism 80, in which a second pump 87 and an exhaust valve 25 are arranged) is positioned below the CIS 16 and the cutter unit 26.

[Circulating Mechanism 80]

Figure 7:
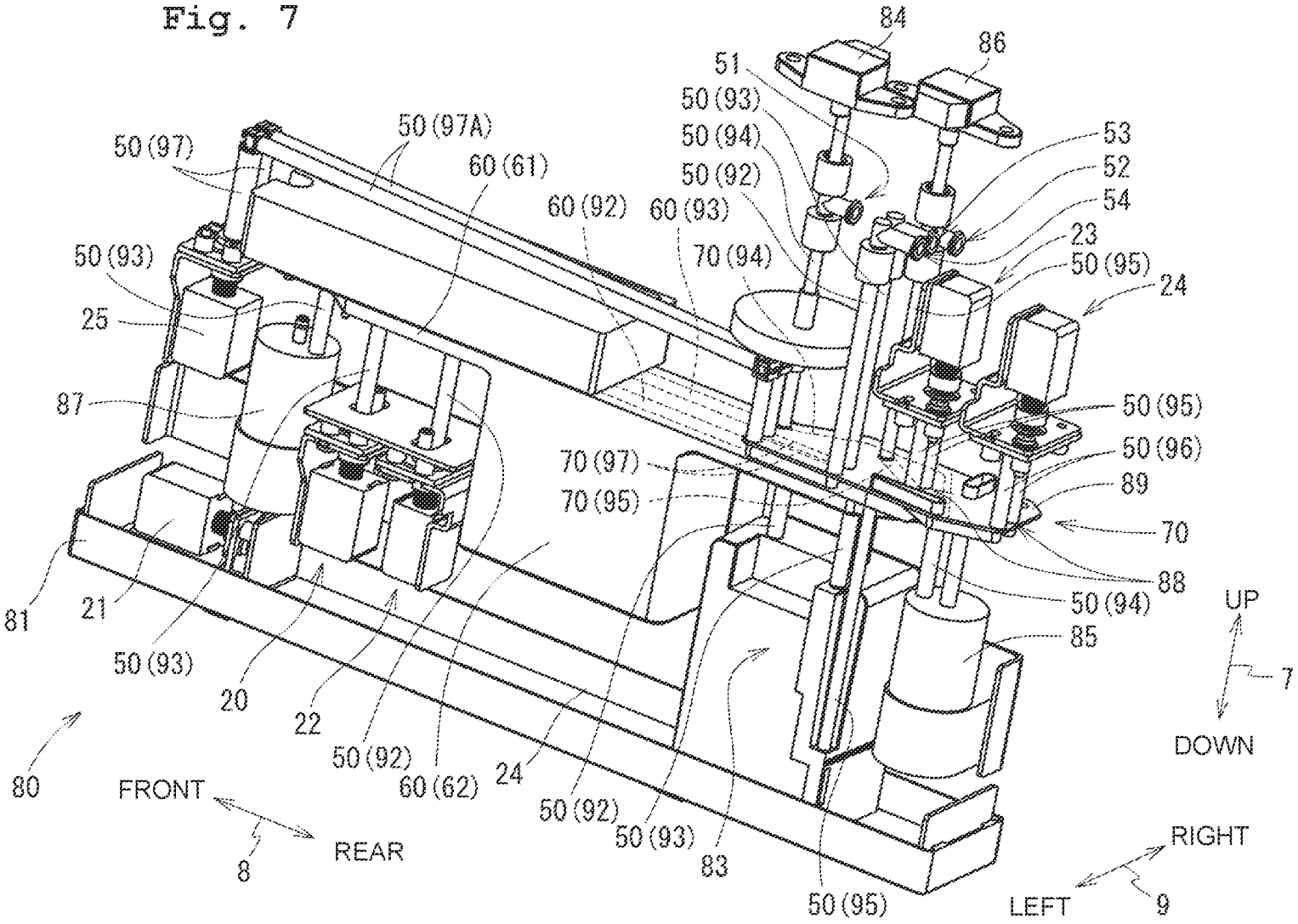
FIG. 7 is a perspective view of the circulating mechanism 80.

As depicted in FIG. 7, the circulating mechanism 80 has such a configuration wherein the respective constitutive elements are assembled to a frame 81. Note that in FIG. 7, only a frame 81 forming a lower part of the circulating mechanism 80 is depicted; illustrations of frames constructing a side part and an upper part of the circulating mechanism 80 are omitted.

As depicted in FIGS. 5 and 7, the respective constitutive elements of the circulating mechanism 80 are: a first channel member 60, a second channel member 70, a plurality of tubular members 50, the sub tank 83 (an example of the "tank"), a first pressure gauge 84, a first pump 85, a second pressure gauge 86, a second pump 87, and a plurality of valves (a replenishing valve 21, an atmospheric release valve 22, a negative pressure adjusting valve 20, a purge shut-off valve 23, a purge bypass valve 24, and an exhaust valve 25). The first channel member 60 and the second channel member 70 are an example of a "channel member".

The first pressure gauge 84, the first pump 85, the second pressure gauge 86, the second pump 87, and the plurality of valve are controlled by the main substrate 129.

Each of the first channel member 60 and the second channel member 70 is an integrally molded member made of a resin. The first channel member 60 is constructed of a main body part 61 and a thick part 62. The main body part 61 has a shape of a flat plate spreading in the front-rear direction 8 and the left-right direction 9. The thick part 62 is a part protruding downward from a central part in the front-rear direction 8 of the main body part 61. The second channel member 70 has a shape of a flat plate spreading in the front-rear direction 8 and the left-right direction 9. The second channel member 70 is stacked above the first channel member 60. A front part of the second channel member 70 makes contact with a rear part of the first channel member 60. Note that the second channel member 70 may be arranged with a spacing distance with respect to the first channel member 60.

Figure 6:
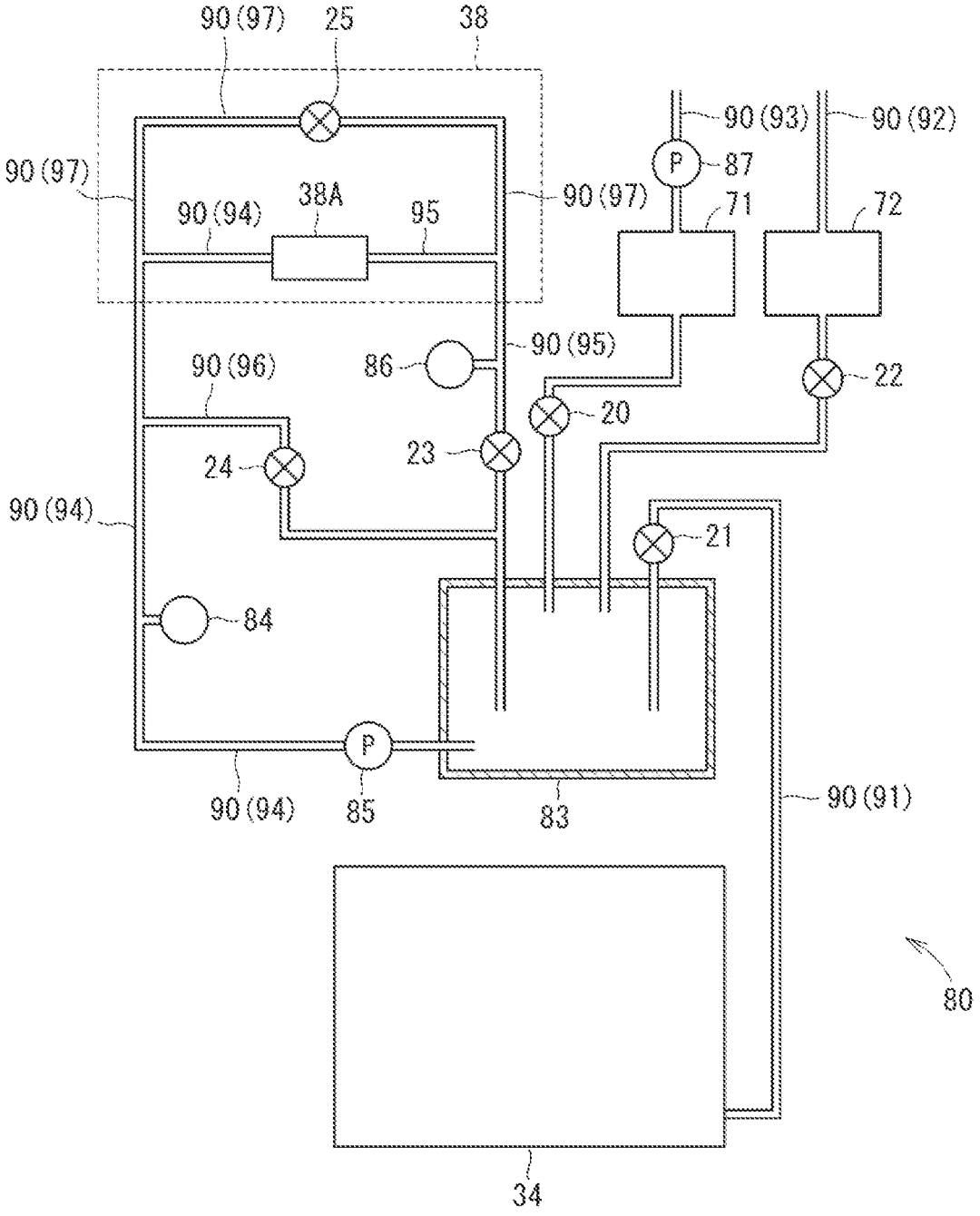
FIG. 6 is a view depicting a piping configuration of a circulating mechanism 80.

Channels 91, 92, 93, 94, 95, 96 and 97 are formed in the first channel member 60 and the second channel member 70 (see FIG. 6). In the following explanation, the plurality of channels 91, 92, 93, 94, 95, 96 and 97 will be collectively referred to as channels 90, in some cases.

As depicted in FIG. 7, each of the channels 90 is formed of a groove formed in the main body part 61 of the first channel member 60 and a groove formed in the second channel member 70, and a plastic plate 89 welded to the main body part 61 and the second channel member 70 so as to cover the grooves. Note that it is allowable that a film, etc., is joined to the main body part 61 and the second channel member 70 by welding, etc., rather than the resin plate 89.

Each of the first channel member 60 and the second channel member 70 has a plurality of holes 88 (an example of a "port") in the upper and lower surfaces thereof. The channels 90 and the outsides of the first channel member 60 and the second channel member 70 are communicated with one another via the plurality of holes 88.

Each of the plurality of tubular members 50 is formed of a rubber, a resin, etc., and is a hollow-shaped member of which both ends are opened. Each of the channels 90 is formed in the internal space of one of the plurality of tubular members 50. One end of each of the plurality of tubular members 50 is connected to one of the plurality of holes 88 formed in the first channel member 60 and the second channel member 70. The other end of each of the plurality of tubular members 50 is connected to one of the respective constitutive elements of the circulating mechanism 80.

The plurality of tubular members 50 are arranged along the up-down direction 7, except for a part of the channel 97 (indicated by a reference numeral "97A" in FIG. 7). That is, each of the channels 90 formed in the internal space of one of the plurality of tubular members 50 is along the up-down direction 7. On the other hand, each of the channels 90 formed in the first channel member 60 and the second channel member 70 is along the horizontal direction. That is, in the channels 90, the part thereof along the up-down direction 7 is constructed of each of the tubular members 50, and the part thereof along the horizontal direction is constructed of the first channel member 60 and the second channel member 70. Namely, a part of the channels 90 is constructed of at least one of the first channel member 60 and the second channel member 70, and another part of the channels 90 is constructed of each of the plurality of tubular members 50.

In FIG. 7, the first channel member 60 constructs a part of the channel 92 and a part of the channel 93. Further, the second channel member 70 constructs a part of the channel 94, a part of the channel 95 and a part of the channel 97. It is allowable, of course, that the first channel member 60 constructs a part, of the channels 90, different from the channels 92 and 93, or that the second channel member 70 constructs a part, of the channels 90, different from the channels 94, 95 and 97. Note that in FIG. 7, the channels 90 depicted in dashed lines on the first channel member 60 and the second channel member 70 in FIG. 7 are an example, and the channels 90 may take other paths or routes different from those depicted in FIG. 7.

As depicted in FIG. 7, the respective constitutive elements of the circulating mechanism 80 are arranged at positions, respectively, facing, in the up-down direction 7, the plurality of holes 88 formed in the first channel member 60 or the second channel member 70.

In the present embodiment, the sub tank 83, the second pump 87, the replenishing valve 21, and the atmospheric release valve 22 are positioned below the first channel member 60, and face, in the up-down direction 7, the plurality of holes 88 formed in the lower surface of the first channel member 60.

Further, the first pump 85 is positioned below the second channel member 70, and faces, in the up-down direction 7, the plurality of holes 88 formed in the lower surface of the second channel member 70.

Furthermore, the first pressure gauge 84 and the second pressure gauge 86 are positioned above the second channel member 70, and faces, in the up-down direction 7, the plurality of holes 88 formed in the upper surface of the second channel member 70.

The respective constituent elements of the circulating mechanism 80 face the plurality of holes 88 corresponding to the piping configuration as depicted in FIG. 6. Further, for example, the sub tank 83 faces four holes 88; these four holes 88 communicate with the channels 91, 92, 93 and 95, respectively. Furthermore, for example, the first pump 85 faces one hole 88; the one hole 88 communicates with the channel 94.

Note that in FIG. 7, although four tubular members connected to ports 51, 52, 53 and 54 are omitted in the illustration, one ends of the four tubular members communicate with the ports 51, 52, 53 and 54, and the other ends of the four tubular members communicate with the head 38. Thus, an internal part of the head 38 having the piping configuration as depicted in FIG. 6 is realized.

As depicted in FIG. 5, the thick part 62 has an internal space. The internal space is divided into two internal spaces by a non-illustrated partition wall. The partition wall is a wall spreading in the up-down direction 7 and the front-rear direction 8. One of the two internal spaces is a first buffer space 71, and the other of the two internal spaces is a second buffer space 72. The first buffer space 71 and the second buffer space 72 are formed to be arranged side by side in the left-right direction 9.

In the following, the connections of the respective constitutive elements of the circulating mechanism 80 will explained, with reference to FIG. 6.

One end of the channel 91 is connected to the main tank 34. The other end of the channel 91 is connected to the sub tank 83. In the present embodiment, the other end of the channel 91 extends, while passing through a through hole formed in an upper end part of the sub tank 83, up to a lower part of the sub tank 83. That is, the channel 91 is a channel connecting the main tank 34 and the sub tank 83. The sub tank 83 stores the ink flowed from the main tank 34.

The replenishment valve 21 is arranged in the channel 91. In a case that the replenishing valve 21 is opened, the ink can be supplied from the main tank 34 to the sub tank 83. In a case that the replenishing valve 21 is closed, the ink is not supplied from the main tank 34 to the sub tank 83.

One end of the channel 92 (an example of a "fourth the channel") is connected to a hole opened in the upper end part of the sub tank 83. The other end of the channel 92 is open to the atmosphere. That is, the channel 92 communicates the sub tank 83 with the atmosphere.

The atmospheric release valve 22 is arranged in the channel 92. In a case that the atmospheric release valve 22 is opened, the sub tank 83 is opened to the atmosphere. In a case that the atmospheric release valve 22 is closed, the sub tank 83 is not released to the atmosphere via the channel 92.

The second buffer space 72 is formed in the channel 92 at a part thereof between the atmospheric release valve 22 and the other end of the channel 92. The second buffer space 72 is provided to reduce such a situation that the ink stored in the sub tank 83 is evaporated through the channel 92. Note that the second buffer space 72 may be formed in a part, of the channel 92, between one end of the channel 92 and the atmosphere opening valve 22.

One end of the channel 93 (an example of a "third channel") is connected to a hole which is opened in the upper end part of the sub tank 83. The other end of the channel 93 is released to the atmosphere. Namely, the channel 93 communicates the sub tank 83 with the atmosphere.

The second pump 87 is arranged in the channel 93. The second pump 87 is driven so as to cause the ink to flow from the head 38 to the sub tank 83, via the channel 95, while the head 38 is ejecting or discharging the ink from the plurality of nozzles 38A (while the image recording onto the sheet S is being performed). A publicly known pump is used as the second pump 87. Therefore, any detailed explanation of the configuration of the second pump 87 is omitted.

The negative pressure adjusting valve 20 is arranged in the channel 93 at a part thereof between the sub tank 83 and the second pump 87. By opening and closing the negative pressure adjusting valve 20, the pressure in the sub tank 83 is adjusted.

The first buffer space 71 is formed in the channel 93 at a part thereof between the negative pressure adjusting valve 20 and the second pump 87. Similarly to the second buffer space 72, the first buffer space 71 is provided so as to reduce such a situation that the ink stored in the sub tank 83 is evaporated through the channel 93. Note that the first buffer space 71 may be formed in the channel 93 at a part thereof between the second pump 87 and the other end of the channel 93.

One end of the channel 94 (an example of the "first channel") is connected to a hole formed to be open in a lower end part of the sub tank 83. The other end of the channel 92 is connected to the head 38. The channel 94 in the inside of the head 38 is connected to the nozzle 38A via a non-illustrated manifold and a non-illustrated pressure chamber. The channel 94 communicates the sub tank 83 with the head 38, and causes the ink to flow from the sub tank 83 to the head 38.

The first pump 85 is arranged in the channel 94. The first pump 85 is driven so as to cause the ink to flow from the sub tank 83 to the head 38 via the channel 94, while the head 38 is ejecting or discharging the ink from the plurality of nozzles 38A. As the first pump 85, a publicly known pump is used. Therefore, any detailed explanation of the configuration of the first pump 85 is omitted.

The first pressure gauge 84 is arranged in the channel 94 at a part thereof between the first pump 85 and the head 38. The first pressure gauge 84 detects a pressure (an example of the "first pressure") between the sub tank 83 and the head 38 in the channel 94. As the pressure is higher, an amount of the ink per unit time which is made to flow from the sub tank 83 to the head 38 becomes greater. The value of the detected pressure is outputted to the main substrate 129. As the first pressure gauge 84, a publicly known pressure gauge is used. Therefore, any detailed explanation of the configuration of the first pressure gauge 84 is omitted.

The main substrate 129 controls the driving of the first pump 85, based on the pressure value inputted from the first pressure gauge 84. For example, in a case that the pressure value inputted from the first pressure gauge 84 becomes to be great, the main substrate 129 controls the first pump 85 so as to reduce the driving force of the first pump 85 to be small; in a case that the pressure value inputted from the first pressure gauge 84 becomes to be small, the main substrate 129 controls the first pump 85 so as to increase the driving force of the first pump 85 to be great. As a result, the pressure in the channel 94 is adjusted by the first pump 85, and the amount of ink per unit time flowing from the sub tank 83 to the head 38 is adjusted.

One end of the channel 95 (an example of a "second channel") is connected to the head 38. The other end of the channel 95 is connected to the sub tank 83. In the present embodiment, the other end of the channel 95 extends, penetrating through a through hole formed in the upper end of the sub tank 83, up to the lower part of the sub tank 83. The channel 95 communicates the sub tank 83 with the head 38, and causes the ink to flow from the head 38 to the sub tank 83.

The purge shut-off valve 23 is arranged in the channel 95. The purge shut-off valve 23 opens and closes the channel 95.

The second pressure gauge 86 is arranged in the channel 95 at a part thereof between the head 38 and the purge shut-off valve 23. The second pressure gauge 86 detects a pressure (an example of a "second pressure") between the head 38 and the sub tank 83 in the channel 95. As the pressure is higher, the amount of ink per unit time which is made to flow from the head 38 to the sub tank 83 becomes greater. The value of the detected pressure is outputted to the main substrate 129. A publicly known pressure gauge is used as the second pressure gauge 86. Therefore, any detailed explanation of the configuration of the second pressure gauge 86 is omitted.

The main substrate 129 controls the driving of the second pump 87, based on the pressure value inputted from the second pressure gauge 86. For example, in a case that the value of the pressure inputted from the second pressure gauge 86 becomes to be great, the main substrate 129 controls the second pump 87 so as to reduce the driving force of the second pump 87 to be small; in a case that the value of the pressure inputted from the second pressure gauge 86 becomes to be small, the main substrate 129 controls the second pump 87 and the opening/closing of the negative pressure valve 20 so as to increase the driving force of the second pump 87 to be great. By doing so, the pressure in the inside of the channel 95 is adjusted by the second pump 87, and thus the amount of the ink per unit time which is made to flow from the head 38 to the sub tank 83 is adjusted.

One end of the channel 96 is connected to a part, of the channel 94, which is between the first pressure gauge 84 and the head 38. The other end of the channel 96 is connected to a part, of the channel 95, which is between the purge shut-off valve 23 and the sub tank 83. The purge bypass valve 24 is arranged in the channel 96. The purge bypass valve 24 is opened to thereby allow the flow of ink in the channel 96, and is closed to thereby shut off or block the flow of ink in the channel 96. The effects of the channel 96 and the purge bypass valve 24 will be described later on.

The channel 97 is provided on the head 38. One end of the channel 97 is connected to the channel 94. The other end of the channel 97 is connected to the channel 95. The exhaust valve 25 is arranged in the channel 97. The exhausted valve 25 is opened to thereby allow the flow of ink in the channel 97, and is closed to thereby shut off the flow of ink in the channel 97. The effects of the channel 97 and the exhaust valves 25 will be described later on.

In a recording state in which the image recording with respect to the sheet S is being performed, the main substrate 129 opens the purge shut-off valve 23 and closes the purge bypass valve 24 and the exhaust valve 25. This creates a circulation path from the sub tank 83 and returning back to the sub tank 83 again, via the channel 94, the nozzle 38A, and the channel 95. In this state, the main substrate 129 drives the first pump 85 and the second pump 87. This causes the ink to circulate in the following order of: the sub tank 83, the channel 94, the nozzle 38A, and the channel 95. The ink is ejected or discharged from the nozzle 38A in a process in which the ink flows in the head 38. At this time, the main substrate 129 controls the driving of the first pump 85 and the driving of the second pump 87 based on the values of the pressures inputted from the first pressure gauge 84 and the second pressure gauge 86, respectively, as described above, to thereby control the pressures inside the channels 94 and 95, respectively.

Note that in the recording state, each of the replenishing valve 21 and the atmospheric release valve 22 is opened and closed as necessary. For example, in a case that the ink needs to be supplied from the main tank 34 to the sub tank 83, the supply valve 21 is opened.

In a standby state in which the image recording with respect to the sheet S is not executed, the main substrate 129 opens the purge bypass valve 24 and closes the purge shut-off valve 23 and the exhaust valve 25. By doing so, a path for supplying ink from the sub tank 83 to the head 38 via the channel 95 and the channel 96 is formed.

In the standby state, the discharge of the ink is not executed, and thus there is such a fear that the ink around the nozzle 38A might be dried. However, even in such a case, the ink can be supplied to the head 38 via the above-described path, without driving the first pump 85 and/or the second pump 87. With this, it is possible to prevent the ink around the nozzle 38A from being dried. Note that in a case that the first pump 85 is not driven, a path leading from the sub tank 83 to the head 38 via the first pump 85 has a channel resistance which is too high, and thus the ink cannot be supplied via this path.

The main substrate 129 executes an exhaust operation as necessary. In a case that the main substrate 129 executes the exhaust operation, the main substrate 129 opens the purge shut-off valve 23 and the exhaust valve 25 and closes the purge bypass valve 24. By doing so, in addition to a first circulation path from the sub tank 83 and returning back again to the sub tank 83 via the channel 94, the nozzle 38A and the channel 95, a second circulation path from the sub tank 83 and returning back again to the sub tank 83, via the channel 94, the channel 97 and the channel 95, is formed. In this state, the main substrate 129 drives the first pump 85 and the second pump 87. By doing so, the ink circulates through the first circulation path and the second circulation path. Here, although not depicted in the drawings, the channel 97 is positioned above the channel 94 at a branching position of the channel 94 and the channel 97. Therefore, a certain air bubble in the channel 94 flows through the channel 97, not through the channel 94, and is collected in the sub tank 83. With this, it is possible to reduce such a situation that the air bubble is discharged from the nozzle 38A.

[Layout in Circulating Mechanism 80]

In the following, the layout of the constitutive elements of the circulating mechanism 80 will be explained.

As depicted in FIGS. 3 and 4, the internal space 30A of the casing 30 is divided into two spaces (a first space 11 and a second space 12), by a first virtual surface 1 and a second virtual surface 2. Each of the first virtual surface 1 and the second virtual surface 2 is a surface spreading or extending in the up-down direction 7 and the front-rear direction 8 (conveyance direction 8A). The first space 11 (see FIG. 2) is a space between the first virtual surface 1 and the second virtual surface 2 in the internal space 30A. The second space 12 is a space different from the first space 11 in the internal space 30A. In the present embodiment, the second virtual surface 2 is located at a right end of the internal space 30A. Therefore, the second space 12 is a space on the left side, with respect to the first space 11, in the internal space 30A. That is, the second space 12 is located on one side in the left-right direction 9 of the first space 11.

The head 38 and the conveying belt 101 are positioned in the first space 11. Further, the holder 35, the tensioner 45, the conveying roller pair 36, the conveying roller pair 40, the supporting member 46, the CIS 16, and the cutter unit 26 as depicted in FIG. 2 are also positioned in the first space 11. In the present embodiment, as depicted in FIG. 4, although the main tank 34 and the fixing part 39 are located straddling over both of the first space 11 and the second space 12, the main tank 34 and the fixing part 39 may be located only in the first space 11. Further, in the present embodiment, although the tensioner 45, the conveying roller pair 36, the conveying roller pair 40, the conveying belt 101, the head 38, the supporting member 46, the CIS 16 and the cutter unit 26 are positioned only in the first space 11, it is allowable that members different from the head 38 are positioned across or over both the first space 11 and the second space 12.

As depicted in FIGS. 3 and 4, the circulating mechanism 80 is positioned in the second space 12. Note that in the present embodiment, although all of the circulating mechanism 80 is positioned in the second space 12, it is allowable that, among the circulating mechanism 80, at least the sub tank 83, the first pressure gauge 84, the first pump 85, the second pressure gauge 86 and the second pump 87 are positioned in the second space 12.

Note that the second virtual surface 2 may be located at a position which is different from the right end of the internal space 30A.

For example, the second virtual surface 2 may be positioned at a left end of the internal space 30A. In such a case, the second space 12 is a space, in the internal space 30A, on the right side with respect to the first space 11.

Figure 8:
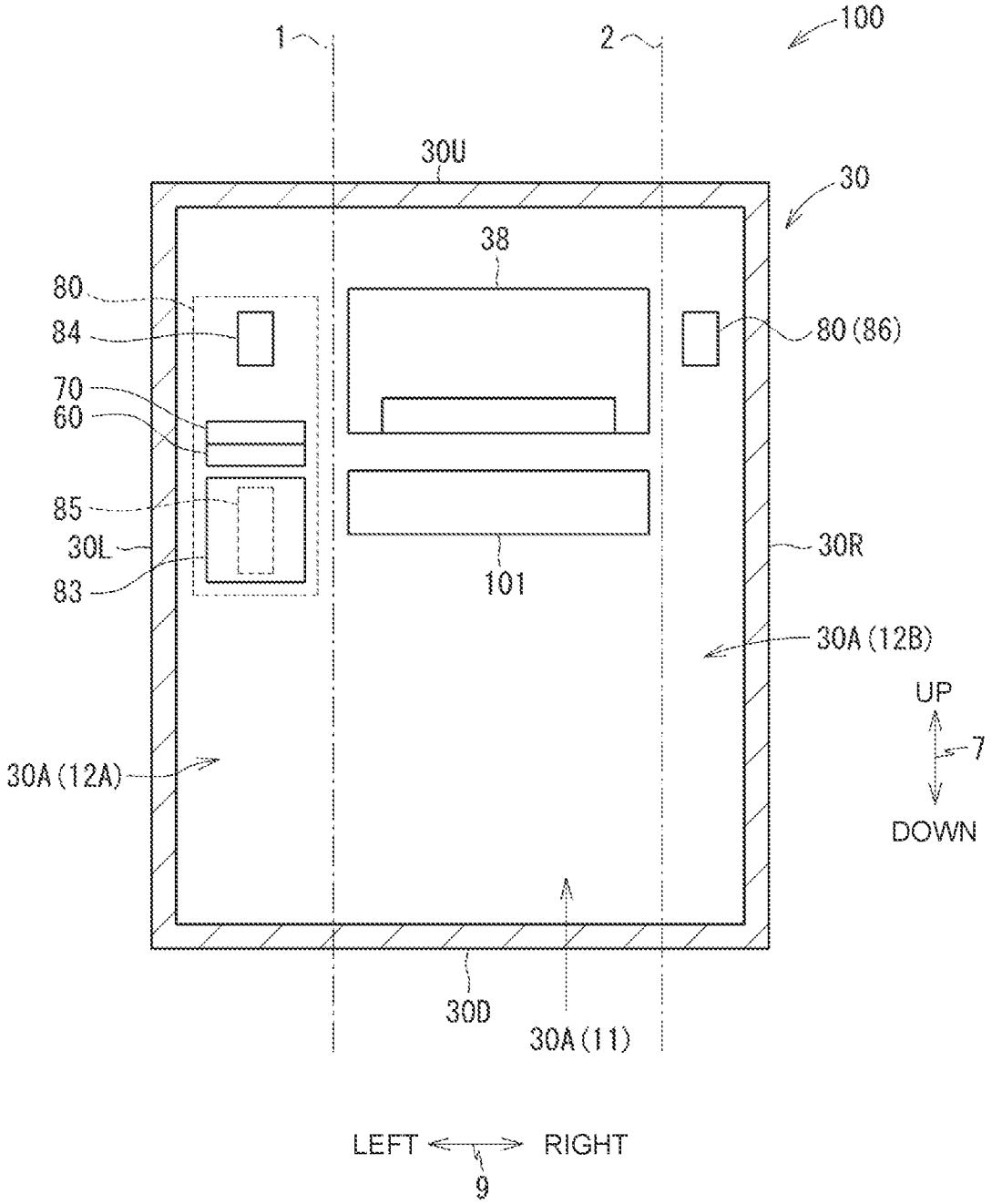
FIG. 8 is a cross-sectional view of an image recording apparatus 100 depicting a modification of FIG. 3.

Further, for example, as depicted in FIG. 8, in a case that the second virtual surface 2 is positioned between the first virtual surface 1 and the right end of the internal space 30A, the internal space 30A is divided into one first space 11 and two second spaces 12A and 12B. The second space 12A is positioned on the left side with respect to the first space 1, and the second space 12B is positioned on the right side with respect to the first space 11. In such a case, a part of the circulating mechanism 80 may be arranged in the second space 12A, and another part of the circulating mechanism 80 may be arranged in the second space 12B. In FIG. 8, the second pressure gauge 86 of the circulating mechanism 80 is arranged in the second space 12B, and the those of the circulating mechanism 80 which are different from the second pressure gauge 86 are arranged in the second space 12A.

As depicted in FIG. 5, the first pump 85, the sub tank 83, the thick part 62 (first buffer space 71 and second buffer space 72), the second pump 87, and the exhaust valve 25 are arranged side by side along the front-rear direction 8 (conveyance direction 8A). The sub tank 83 is positioned in front of the first pump 85. The thick part 62 is positioned in front of the sub tank 83. The second pump 87 is positioned in front of the thick part 62. That is, the thick part 62 (the first buffer space 71 and the second buffer space 72) is positioned between the sub tank 83 and the second pump 87. The exhaust valve 25 is positioned in front of the second pump 87.

Note that as depicted in FIG. 7, the replenishing valve 21 and the atmospheric release valve 22 are located between the thick part 62 and the second pump 87 in the front-rear direction 8. Further, the purge shut-off valve 23 is positioned above the exhaust valve 25, the purge bypass valve 24 is positioned above the thick part 62.

As depicted in FIG. 5, the sub tank 83, the first pump 85 and the second pump 87 are located below the conveyance path 43 in the up-down direction 7.

The first pressure gauge 84 and the second pressure gauge 86 are positioned above the sub tank 83, the first pump 85, the second pump 87, the first channel member 60 and the second channel member 70, in the up-down direction 7.

Further, in the present embodiment, the first pressure gauge 84 and the second pressure gauge 86 are positioned between the upper end and the lower end of the head 38, in the up-down direction 7. That is, the first pressure gauge 84 and the second pressure gauge 86 are located at the same position as the head 38, in the up-down direction 7. Furthermore, the first pressure gauge 84 and the second pressure gauge 86 are positioned between the front end and the rear end of the head 38, in the front-rear direction 8. Moreover, the first pressure gauge 84 and the second pressure gauge 86 are positioned on the left side with respect to the head 38, in the left-right direction 9. From the above-described configuration, as depicted in FIGS. 3 and 5, the first pressure gauge 84 and the second pressure gauge 86 are arranged side by side with the head 38, and on the left side with respect to the head 38 in the left-right direction 9.

As depicted in FIG. 3, a shortest distance L1 in the up-down direction 7 between the head 38 and the first and second pressure gauges 84 and 86 is shorter than a shortest distance L2 in the up-down direction 7 between the head 38 and the sub tank 83, the first pump 85 and the second pump 87.

Here, the shortest distance described above is a distance in the up-down direction 7 between the head 38 and an object (the first pressure gauge 84 and the second pressure gauge 86, or the sub tank 83, the first pump 85 and the second pump 87). As described above, in the present embodiment, the first pressure gauge 84 and the second pressure gauge 86 are positioned at the same position as the head 38 in the up-down direction 7. Therefore, there is no spacing distance in the up-down direction 7 between the head 38 and the first and second pressure gauges 84 and 86. That is, the shortest distance L1 is zero (0). The shortest distance L2 is the distance in the up-down direction 7 between a lower end of the head 38 and an uppermost position of the sub tank 83, the first pump 85 and the second pump 87 (in the present embodiment, an upper end of the sub tank 83). In the present embodiment, the shortest distance L2 is greater than zero (0). That is, as described above, the shortest distance L1 which is zero is shorter than the shortest distance L2 which is greater than zero.

As depicted in FIG. 3, in a line of sight along the front-rear direction 8, an arrangement range R1 of the first pressure gauge 84 and the second pressure gauge 86 overlaps with an arrangement range R2 of the sub tank 83 and the first pump 85. Here, the term "overlapping, overlap(s)" means that at least a part of the arrangement range R1 and at least a part of the arrangement range R2 overlap with each other, and is not limited to the overlapping states depicted in the respective drawings of the present embodiment. This is similarly applicable to an arrangement range R3 and an arrangement range R4 which will be described later on.

Here, the arrangement range R1 is a range ranging from a rightmost position to a leftmost position of the first pressure gauge 84 and the second pressure gauge 86. In the present embodiment, the first pressure gauge 84 and the second pressure gauge 86 are of a same type and are arranged side by side along the front-rear direction 8 (conveyance direction 8A) (see FIG. 5). In FIG. 3, the second pressure gauge 86 is located on the far side of the sheet surface with respect to the first pressure gauge 84. Therefore, in the left-right direction 9, the right end and the left end of the first pressure gauge 84 and the right end and the left end of the second pressure gauge 86 are at the same positions, respectively. The arrangement range R2 is a range ranging from a rightmost position to a leftmost position of the sub tank 83 and the first pump 85. In the present embodiment, the rightmost position is at the right end of the sub tank 83, and the leftmost position is the left end of the sub tank 83.

Further, as depicted in FIG. 5, in a line of sight along the left-right direction 9, an arrangement range R3 of the first pressure gauge 84 and the second pressure gauge 86 overlaps an arrangement range R4 of the sub tank 83 and the first pump 85.

Here, the arrangement range R3 is a range ranging from a frontmost position to a rearmost position of the first pressure gauge 84 and the second pressure gauge 86. In the present embodiment, the frontmost position is the front end of the first pressure gauge 84, and the rearmost position is the rear end of the second pressure gauge 86. The arrangement range R4 is a range ranging from a frontmost position to a rearmost position of the sub tank 83 and the first pump 85. In the present embodiment, the frontmost position is the front end of the sub tank 83, and the rearmost position is the rear end of the first pump 85.

Further, as described above, the first pressure gauge 84 and the second pressure gauge 86 are positioned above the sub tank 83 and the first pump 85, in the up-down direction 7.

Thus, in the up-down direction 7, the arrangement range of the first pressure gauge 84 and the second pressure gauge 86 is aligned with the arrangement range of the sub tank 83 and the first pump 85.

The thick part 62 of the first channel member 60 and the second pump 87 are located on the front side with respect to the arrangement area R3. In other words, the thick part 62 of the first channel member 60 and the second pump 87 are shifted to the upstream side in the conveyance direction 8A from the arrangement range R3. Note that the thick part 62 of the first channel member 60 and the second pumps 87 may be shifted to the downstream side in the conveyance direction 8A from the arrangement range R3.

<Effects of Image Recording Apparatus 100>

According to the above-described embodiment, the head 38 is positioned in the first space 11; and the sub tank 83, the first pump 85, the first pressure gauge 84, the second pump 87 and the second pressure gauge 86 are positioned in the second space 12. That is, the sub tank 83, the first pump 85, the first pressure gauge 84, the second pump 87 and the second pressure gauge 86 are not provided immediately above or below the head 38. Therefore, it is possible to suppress any increase in the size of the image recording apparatus 100 in the up-down direction 7. Further, in a case that the ink leaks from the channel 94 and/or the channel 95, it is possible to avoid such a situation that the leaked ink adheres to the head 38.

Further, in such a case that the first pressure gauge 84 and the second pressure gauge 86 are arranged above or below the head 38, it is impossible to arrange the first pressure gauge 84 and the second pressure gauge 86 at the same height as the head. However, in the embodiment as described above, the first pressure gauge 84 and the second pressure gauge 86 can be arranged beside the head 38 in the left-right direction 9. Therefore, it is possible to place the first pressure gauge 84 and the second pressure gauge 86 at the same height as the head 38. Thus, it is possible to detect a value close to the pressure in the head 38 by the first pressure gauge 84 and the second pressure gauge 86.

Furthermore, according to the above-described embodiment, since the sub tank 83, the first pump 85, and the second pump 87 are arranged side by side along the conveyance direction 8A, it is possible to suppress any increase in the size in the left-right direction 9 of the image recording apparatus 100, as compared with such a configuration in which the sub tank 83, the first pump 85, and the second pump 87 are arranged side by side in the left-right direction 9.

Moreover, according to the above-described embodiment, since the second space 12 is located on one side in the left-right direction 9 with respect to the first space 11, it is possible to suppress any increase in the size in the left-right direction 9 of the image recording apparatus 100.

Further, according to the above-described embodiment, since the first pressure gauge 84 and the second pressure gauge 86 can be arranged near the head 38 in the up-down direction 7, it is possible to detect a value close to the pressure in the head 38, by the first pressure gauge 84 and the second pressure gauge 86.

Furthermore, since the sub tank 83, the first pump 85 and the second pump 87 are positioned below the conveyance path 43, if the ink stored in the inside of each of the sub tank 83, the first pump 85 and the second pump 87 leaks, it is possible to lower such a possibility that the leaked ink adheres to the conveyance path 43 or to the sheet S on the conveyance path 43.

Moreover, in such a case that the bending or curving, of the channel 90, between the horizontal and the up-down direction 7 is reproduced by a tubular member such as a tube, it is necessary to bend the tubular member at the bent or curved part of the channel 90, or to use a dedicated joint component therefor.

On the other hand, in the present embodiment, it is possible to construct a channel 90 along the horizontal direction (the front-rear direction 8 and the left-right direction 9) by the first channel member 60 and the second channel member 70, and to construct a channel 90 along the up-down direction 7 by the tubular member 50. That is, in the present embodiment, it is possible to realize the bending or curving, of the channel 90, between the horizontal and the up-down direction 7, by connecting the first and second channel members 60 and 70 and the tubular member 50, thus thereby making it possible to realize the bending or curving easily with a simple configuration, without bending the tubular member and/or without using a dedicated joint component.

The first buffer space 71 communicating with the channel 93 is easily realized by simply increasing the size of the first channel member 60 to such an extent corresponding to the first buffer space 71.

Further, according to the above-described embodiment, since the sub tank 83, the second pump 87 and the first buffer space 71 are arranged side by side along the conveyance direction 8A, it is possible to suppress any increase in the size in the left-right direction 9 of the image recording apparatus 100, as compared with such a configuration wherein the sub tank 83, the second pump 87, and the first buffer space 71 are arranged side by side along the left-right direction 9.

Furthermore, since the first pressure gauge 84 and the second pressure gauge 86 are positioned at the same height as the head 38 and are arranged side by side with respect to the head 38 in the left-right direction 9, a value close to the pressure in the head 38 can be detected by the first pressure gauge 84 and the second pressure gauge 86.

Moreover, the second buffer space 72 communicating with the channel 92 is easily realized by simply increasing the size of the first channel member 60 to such an extent corresponding to the second buffer space 72.

Further, since the first buffer space 71 and the second buffer space 72 are arranged side by side in the left-right direction 9, it is possible to suppress such a situation that the shape of the first channel member 60 becomes complicated.

[Modifications]

The layout within the circulating mechanism 80 may take a layout other than that depicted in the above-described embodiment, except that the head 38 is positioned in the first space 11 and that the sub tank 83, the first pressure gauge 84, the first pump 85, the second pressure gauge 86 and the second pump 87 are positioned in the second space 12. For example, it is allowable that the first pressure gauge 84 and the second pressure gauge 86 are arranged below the head 38. Further, for example, it is allowable that the sub tank 83, the first pump 85 and the second pump 87 are not arranged side by side along the front-rear direction 8. Furthermore, for example, it is allowable that the arrangement range R2 and the arrangement range R3 do not overlap with each other in the line of sight along the front-rear direction 8.

In the above-described embodiment, the channel member is divided into two members which are the first channel member 60 and the second channel member 70. It is allowable, however, that the channel member is a single member or that the channel member is divided into not less than three members.

In the above-described embodiment, the ink flows from the main tank 34 to the sub tank 83; the sub tank 83 and the head 38 are connected via the channels 94 and 95; and the ink circulates between the sub tank 83 and the head 38. It is allowable, however, to provide such a configuration that the sub tank 83 is not provided and that the main tank 34 and the head 38 are connected via the channel 94 and 95, thereby allowing the ink to circulate between the main tank 34 and the head 38. In such a case, the channel 92 and 93 are also connected to the main tank 34. Further, in this case, the main tank 34 corresponds to the "tank".

In the above-described embodiment, the main tank 34 is detachably attached with respect to the casing 30. This allows the main tank 34 to supply a new ink to the head 38, by replacing the main tank 34 with a new main tank 34. The main tank 34, however, is not limited to this. It is allowable, for example, that the main tank 34 is provided with a replenishing port 15 as depicted in dashed lines in FIG. 2. The replenishing port 15 communicates the inside and outside of the main tank 34. A non-illustrated bottle in which the ink is stored is installed in the replenishing port 15 to thereby replenish or refill the main tank 34 with the ink from the bottle. Note that in a case of providing such a configuration, it is allowable that the main tank 34 is not detachably attached with respect to the casing 30 and that the main tank 34 is fixed to the casing 30.

In the above-described embodiment, although the system in which the head 38 records an image on the sheet S is an ink-jet recording system of the line head type, the image recording system is not limited to this. It is allowable, for example, that the image recording system is an ink-jet recording system of the serial (head) type.

In the above-described embodiment, although the sheet S is explained as an example of the "medium", the medium on which the image recording apparatus 100 records an image is not limited to the sheet S. It is allowable, for example, that the medium on which an image is recorded by the image recording apparatus 100 is a resin member usable for a case of a smart phone, etc., a printed circuit board, a fabric, vinyl, and the like.

In the above-described embodiment, although the ink is explained as an example of the "liquid", it is allowable, for example, that a pre-processing liquid which is discharged or ejected onto a sheet S, etc., prior to the ink at the time of the image recording, water for cleaning or washing the head 38, etc., correspond(s) to the liquid.

In the above-described embodiment, the conveying roller pair 36, the conveying roller pair 40 and the conveying belt 101 are provided as the conveyor. The conveyor, however, is not limited to the conveying roller pair 36, the conveying roller pair 40 and conveying belt 101. It is allowable, for example, that the conveyor is not provided with the roller pair, and that the conveyor is constructed only of one piece or a plurality of pieces of a conveying belt. Alternatively, contrary to the above, it is allowable, for example, that the conveyor is not provided with the conveying belt(s) and that the conveyor is constructed only of one piece or a plurality of pieces of a roller pair. Of course, it is allowable that the conveyor is provided with both the roller pair(s) and the conveyor belt(s). It is allowable, for example, that the conveyor is provided with a conveying belt instead of the conveying roller pair 36, 40, and is provided with the roller pair instead of the conveying belt 101.

Further, it is allowable that the conveyor is a stage configured to move a medium in the X-Y axis. The stage, for example, is configured to support the resin member described above as the medium and to move the resin member supported therein in the X direction (the front-rear direction 8) and the Y direction (the left-right direction 9).

In the above-described embodiment, although the image recording apparatus 100 records an image on a medium such as the sheet S, etc., by the ink-jet recording system, the image recording system of the image recording apparatus 100 is not limited to the ink-jet recording system.

For example, the image recording apparatus 100 may record an image on the medium such as the sheet S, etc., by an electrophotographic system. In this case, the above-described pre-processing liquid is, for example, a liquid which assists fixation of a toner to the medium. The pre-processing liquid is discharged or ejected from a pre-processing liquid head provided to discharge or eject the pre-processing liquid to the medium before the fixing is performed for the medium. By discharging or ejecting the pre-processing liquid to the medium, it is possible to perform the fixing of the ink by the fixing part 39 at a lower temperature, as compared with a case that the pre-processing liquid is not discharged or ejected to the medium.

Further, it is allowable, for example, that the image recording apparatus 100 is an apparatus which performs printing of a trace pattern of a printed circuit board. In this case, the printed circuit board corresponds to the medium, and an ink containing metallic particles for printing the trace pattern corresponds to the liquid.

Furthermore, it is allowable, for example, that the image recording apparatus 100 is a 3D printer. In this case, a liquid containing a resin for constructing a three-dimensional object which is to be formed or shaped by the 3D printer corresponds to both the liquid and the medium.

What is claimed is:

1. A printer comprising:

a casing defining an internal space;

a conveyor configured to convey a medium in a conveyance direction;

a head arranged to face the medium conveyed by the conveyor at a location above the medium, and configured to discharge a liquid toward the medium;

a tank configured to store the liquid;

a first channel communicating the tank and the head;

a first pressure gauge positioned in the first channel and configured to detect a first pressure between the tank and the head in the first channel;

a first pump configured to adjust the first pressure;

a second channel communicating the tank and the head;

a second pressure gauge positioned in the second channel and configured to detect a second pressure between the head and the tank in the second channel; and a second pump configured to adjust the second pressure, wherein the internal space includes a first space defined between a first virtual surface and a second virtual surface which are parallel to the conveyance direction and an up-down direction, and a second space which is different from the first space, wherein the head is positioned in the first space, and wherein the tank, the first pressure gauge, the first pump, the second pressure gauge, and the second pump are positioned in the second space.

2. The printer according to claim 1, wherein the tank, the first pump, and the second pump are arranged side by side along the conveyance direction.

3. The printer according to claim 1, wherein the second space is positioned on one side of the first space in a width direction which is orthogonal to the conveyance direction and the up-down direction.

4. The printer according to claim 1, wherein in a case that a shorter distance between a distance in the up-down direction between the head and the first pressure gauge and a distance in the up-down direction between the head and the second pressure gauge is defined as a first distance, and that a shortest distance among a distance in the up-down direction between the head and the tank, a distance in the up-down direction between the head and the first pump, and a distance in the up-down direction between the head and the second pump is defined as a second distance, the first distance is shorter than the second distance.

5. The printer according to claim 1, wherein the first pressure gauge and the second pressure gauge are arranged side by side along the conveyance direction.

6. The printer according to claim 1, wherein each of the tank, the first pump, and the second pump is positioned at a location below the medium facing the head.

7. The printer according to claim 1, wherein the second pump is positioned in a third channel which communicates the tank with atmosphere, wherein the printer further comprises a channel member which is positioned in the second space, and which defines a part of the first channel, a part of the second channel, and a part of the third channel;

wherein the channel member includes three ports connected to the first channel, the second channel, and the third channel, respectively, and wherein the three ports face the tank, the first pump and the second pump, respectively, in the up-down direction.

8. The printer according to claim 7, wherein the channel member defines a first buffer space, and wherein the first buffer space is positioned in the third channel at a location between the tank and the second pump.

9. The printer according to claim 8, wherein the tank, the second pump, and the first buffer space are arranged side by side along the conveyance direction, and wherein the first buffer space is positioned between the tank and the second pump.

10. The printer according to claim 9, wherein in the up-down direction, an arrangement range of the first pressure gauge and the second pressure gauge is aligned with an arrangement range of the tank and the first pump, wherein further in the up-down direction, each of the first pressure gauge and the second pressure gauge is positioned at a location above the tank, the first pump, and the second pump, wherein the first buffer space and the second pump are located at an upstream or downstream of the arrangement range of the first pressure gauge and the second pressure gauge in the conveyance direction, and wherein the first pressure gauge and the second pressure gauge are located at a same position as the head in the up-down direction and are arranged side by side to the head in a width direction which is orthogonal to the conveyance orientation and the up-down direction.

11. The printer according to claim 8, wherein the channel member defines a part of a fourth channel which communicates the tank with atmosphere.

12. The printer according to claim 11, wherein the channel member defines a second buffer space in the fourth channel, and wherein the first buffer space and the second buffer space are arranged side by side in a width direction which is orthogonal to the conveyance direction and the up-down direction.

13. The printer according to claim 1, wherein the tank includes a first tank configured to store the liquid, and a second tank configured to store the liquid flowed from the first tank, wherein the printer includes a tank holder configured to hold the first tank to be detachable, and wherein the first channel and the second channel are connected to the second tank.

14. The printer according to claim 1, wherein the tank includes a first tank including a replenishing port via which the liquid is replenished, and a second tank configured to store the liquid flowed from the first tank, and wherein the first channel and the second channel are connected to the second tank.

* * * * *